US009198530B1

(12) United States Patent
Bunk

(10) Patent No.: US 9,198,530 B1
(45) Date of Patent: Dec. 1, 2015

(54) FOOTWEAR DONNING AND REMOVAL SYSTEM

(71) Applicant: David Bunk, Baltimore, MD (US)

(72) Inventor: David Bunk, Baltimore, MD (US)

( * ) Notice: Subject to any disclaimer, the term of this patent is extended or adjusted under 35 U.S.C. 154(b) by 0 days.

(21) Appl. No.: 14/283,381

(22) Filed: May 21, 2014

(51) Int. Cl.
*A47G 25/90* (2006.01)

(52) U.S. Cl.
CPC ..... *A47G 25/907* (2013.01); *A47G 25/905* (2013.01)

(58) Field of Classification Search
CPC ..... A47G 25/80; A47G 25/82; A47G 25/84; A47G 25/845; A47G 25/86; A47G 25/90; A47G 25/905; A47G 25/907
USPC ..... 223/111–114
See application file for complete search history.

(56) References Cited

U.S. PATENT DOCUMENTS

| | | | | |
|---|---|---|---|---|
| 4,667,861 | A * | 5/1987 | Harrington et al. | 223/113 |
| 4,683,876 | A * | 8/1987 | Changras | 223/113 |
| 5,082,154 | A * | 1/1992 | French | 223/112 |
| 5,632,424 | A * | 5/1997 | Maier et al. | 223/112 |
| 5,799,844 | A | 9/1998 | James | |
| 6,056,171 | A * | 5/2000 | Santamaria | 223/112 |
| 6,102,262 | A * | 8/2000 | Nicholson | 223/112 |
| 6,409,692 | B1 * | 6/2002 | Covey | 602/5 |
| 6,932,252 | B2 | 8/2005 | Simmons | |
| 7,070,074 | B2 | 7/2006 | Landsberger et al. | |
| 7,699,195 | B2 | 4/2010 | Scott | |
| 7,975,886 | B2 | 7/2011 | McAllister et al. | |
| 8,083,110 | B2 | 12/2011 | Wilkens | |
| 8,356,735 | B1 * | 1/2013 | Drakeford | 223/112 |
| 8,393,503 | B2 | 3/2013 | Moscato | |
| 8,474,666 | B2 * | 7/2013 | Vitillo et al. | 223/113 |
| 8,528,796 | B1 | 9/2013 | Bosko et al. | |
| 2004/0104254 | A1 | 6/2004 | Klammer | |
| 2004/0149789 | A1 * | 8/2004 | Landsberger et al. | 223/112 |
| 2006/0027612 | A1 * | 2/2006 | Boaron | 223/111 |
| 2007/0062986 | A1 | 3/2007 | Doud | |
| 2007/0145086 | A1 | 6/2007 | Perez | |
| 2009/0120975 | A1 | 5/2009 | Schoepe | |
| 2013/0082076 | A1 * | 4/2013 | Vitillo et al. | 223/113 |

* cited by examiner

*Primary Examiner* — Nathan Durham
(74) *Attorney, Agent, or Firm* — Rosenberg, Klein & Lee

(57) ABSTRACT

A footwear donning and removal system includes a leg and foot guide mechanism forming an open cross-sectionally contoured L-shaped passageway. A frictional member is mounted to the leg and foot guide mechanism within the open passageway. A platform is mounted to a lower surface of the leg and foot guide mechanism so that the leg and foot guide mechanism is stabilized when the leg and foot of a user is reversibly inserted into the L-shaped open passageway.

18 Claims, 14 Drawing Sheets

FOOTWEAR DONNING AND REMOVAL SYSTEM

BACKGROUND OF THE INVENTION

1. Field of the Invention

The present system relates to a mechanism for donning and/or removal of footwear to and from a user. In particular, this system provides for a donning and/or removal mechanism for footwear to be used by users who are incapable of leaning over or bending to the side for donning and/or removal of footwear. Still further, the subject system relates to devices for permitting physically limited persons to don/remove footwear.

2. Description of Related Art

Numerous systems and assemblies have been provided for assisting obese, arthritic, and persons with limited physical capabilities in donning and removal of footwear.

Many of the prior art systems use what is commonly termed a sock caddy, slide member, trough, or shell to hold the footwear open in a position to accept the foot of a user.

Users with limited flexibility may find it difficult to use flexible lines, cords, straps, fabric tapes, or other pliant materials to act as a guide in removal/donning of footwear. The present system obviates the aforementioned disadvantages by providing a system which is completely open and allows a person to insert his/her foot into the footwear without the necessity of bending and/or leaning.

Known prior art include U.S. Pat. Nos. 8,356,735; 7,070,074; Publication #2004/0104254; U.S. Pat. No. 5,082,154; Publication #2009/0120975; U.S. Pat. Nos. 6,102,262; 5,632,424; 5,799,844; 6,056,171; 6,932,252; 7,699,195; 7,975,886; 8,083,110; 8,393,503; 8,528,796; Publications #2007/0062986; and, #2007/0145086.

U.S. Pat. No. 8,356,735 relies upon an open-tube shaped device which is electronically controlled to facilitate hosiery donning and removal. The complex nature of the electronic elements make the device prone to malfunction and also a higher likelihood of needing to replace parts on a frequent basis.

U.S. Pat. No. 7,070,074 is directed to a hosiery donning aid equipped with independent handles to ease the process of donning hosiery for certain individuals with limited dexterity. Specifically, the handles are intended to provide a means by which users can steady themselves during hosiery donning. The reference provides a guiding and support surface for, in particular, the user's leg and heel but does not provide for a guide passageway which is contoured to also accommodate the bottom portion of a user's foot. Additionally, U.S. Pat. No. 7,070,074 fails to provide for a platform which helps to structurally reinforce the L-shaped open passageway of the subject device. Indeed, the device is intended to be able to be shipped and assembled easily which limits some of the structural integrity.

U.S. Pat. No. 8,083,110 is directed to an aid for pulling on stockings, and in particular, compression stockings. The device includes a substantially C-shaped base frame and a pair of spaced handles which provide a gripping surface for the user as he or she is donning their stockings.

U.S. Publication #2004/0104254 is directed to a device for facilitating donning a sock on a foot wherein the sock received a movable frame which is swingingly attached to a stationary frame. Such structural configuration limits the stability of the device and the connectivity of elements that are movable with respect to one another creates a greater likelihood of elements being damaged and needing to be replaced.

The footwear donning assist assembly of U.S. Pat. No. 5,082,154 includes a foot support member hingedly attached to a T-shaped base member at a first end and supported by a foot support mount 19 at a second end whereby the foot support member takes on an upwardly slanted configuration with respect to the base member. A sleeve-like foot receiving member attached to the foot support member thereby adopts the same slanted configuration. While effectively enabling donning onto a portion of the user's foot, the assembly does not contain any portion which is configured to accommodate the leg of a user and therefore the overall device is lacking in structural rigidity and integrity.

U.S. Publication #2009/0120975 is directed to and aid for putting on socks which includes a base member attached to a three legged support unit whereby the base extends behind the legs to create an acute angle therebetween. The device does not include any element which provides structural support or guidance to a user's food once it has been inserted into the hosiery. In other words, there is nothing to support the heel and sole portion of a user's foot.

The sock donning device of U.S. Pat. No. 6,102,262 relies upon a roller and hoop assembly to hold an upper portion of a sock open as a user inserts his or her foot. The device lacks elements which provide structural rigidity or support to a user's foot or leg portion during the donning/removal process.

U.S. Pat. No. 5,632,424 is directed to a sock donning assist device which helps a caretaker to put a sock onto a disabled person. The device defines an L-shaped configuration including a substantially vertically-oriented portion for retaining a sock during donning. A horizontally-oriented portion extends from the vertically-oriented portion and provides a gripping space for the caretaker user during sock donning. This device was specifically designed to make it easy for a person to help a disabled individual, and therefore the device is not conducive for use by a disabled individual or person of limited dexterity on their own.

The sock applying aids of U.S. Pat. No. 5,799,844 include a wire frame having a U-shaped portion leading to a pair of projecting free arms and the wire frame is covered with an outer covering. The material of the outer covering forms a channel with side walls for receiving the open end portion of a sock. A user then inserts his or her foot into the open end portion and by pulling on a strap attached to the sock aid frame, the user's sock can be released from the frame-donned onto the user's foot. Yet the dexterity necessary to effectively utilize the straps may be difficult for certain individuals.

The sock donning aid of U.S. Pat. No. 6,056,171 and the sock donning device of U.S. Publication #2007/0062986 both adopt a simple structural configuration allowing them to function much in the same manner as a shoe horn. These devices require a notable amount of user dexterity.

U.S. Pat. No. 6,932,252 is directed to a device which includes a U-shaped caddy and two pivotally attached rigid elongate handles which rotate in relation to the caddy. The device does not contain any supporting element for the back of a user's leg and the rotational nature of the elongate handles presents a likelihood of parts wearing out.

The sock donning system of U.S. Pat. No. 7,699,195 utilizes a pair of grasping poles having clasps at their distal ends to assist a user with donning their socks. The poles essentially function as an extension arm to prevent a user from having to bend forward to don their socks.

The apparatus for donning and/or doffing compression garment disclosed in U.S. Pat. No. 7,975,886 consists of a tubular sleeve made from a sheet of flexible material. The inner and outer surfaces of the tubular sleeve have low coefficients of friction such that a user's leg can be easily slid into the tubular sleeve in contact with the inner surface and the compression garment can easily slide onto the outer surface.

The self-operated device of U.S. Pat. No. 8,393,503 assists users with putting on socks and stockings by virtue of handles linked to telescopic rods.

The sock donning appliance of U.S. Pat. No. 8,528,796 includes a telescopic pole equipped with a support bracket configured for holding a top end of a sock in an open position.

Finally, in U.S. Publication #2007/0145086, a series of tubular support and push pieces are adapted to advance a stocking onto a user's foot and leg.

SUMMARY OF THE INVENTION

Figure 1A:
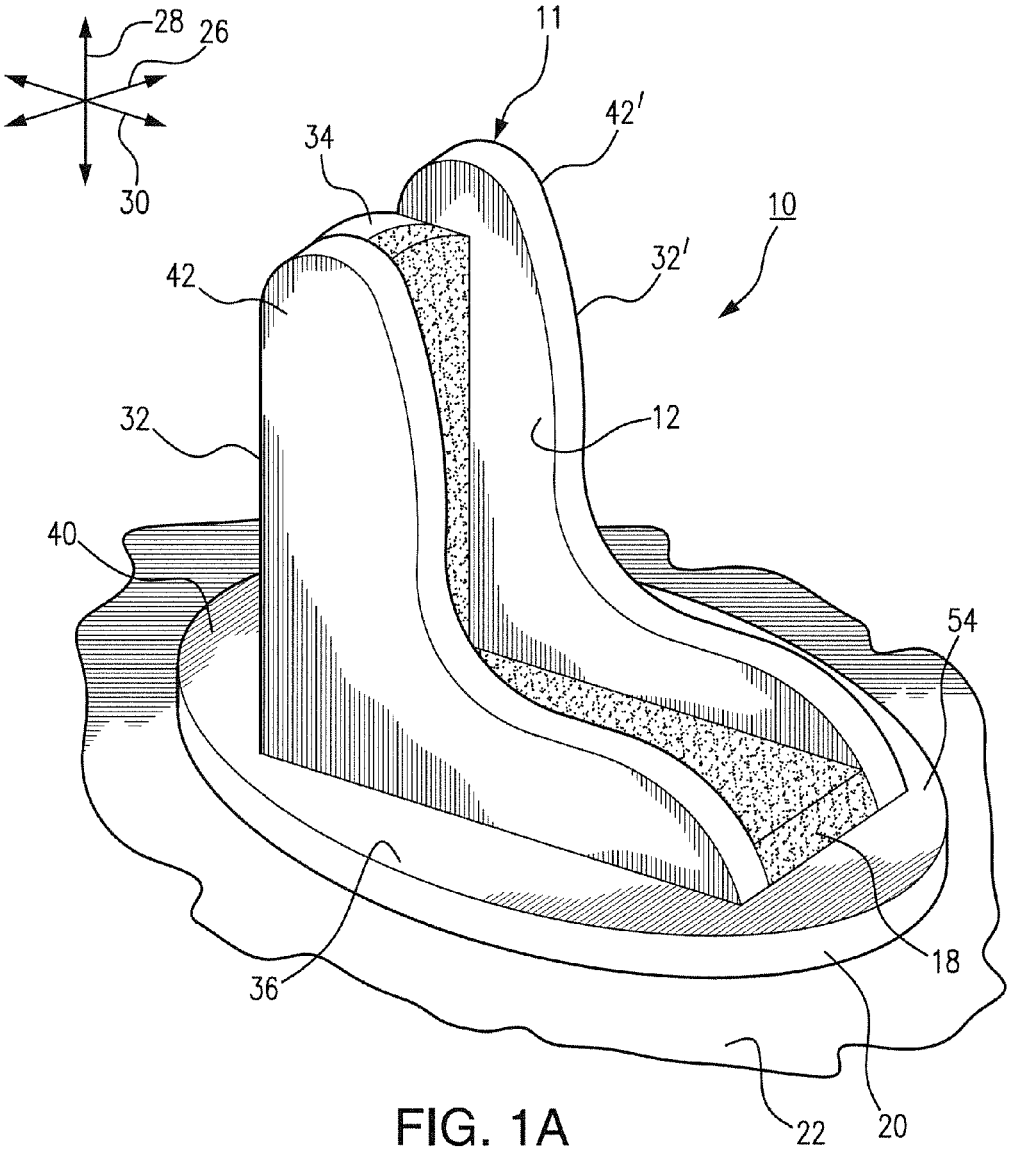
FIG. 1A is a perspective view of footwear donning and removal mechanism interfacing with a base surface.

A footwear donning and removal system is provided which includes a one-piece leg and foot guide mechanism. The one-piece leg and foot guide mechanism forms an L-shaped passageway which has an open cross-sectional contour throughout an overall extension of the leg and foot guide mechanism. The leg and foot guide mechanism is adapted to receive a portion of a leg and foot of a user. A frictional member is mounted to the leg and foot guide mechanism within the L-shaped open passageway. A platform is mounted to the lower surface of the leg and foot guide mechanism, whereby the leg and foot guide mechanism is stabilized when the leg and foot of the user is reversibly inserted into the L-shaped open passageway.

An object of the subject system is to permit persons who are physically limited to don and remove footwear.

It is a further object of the subject system to assist persons with physical limitations that make it difficult or impossible for them to don and remove socks without assistance.

It is another object of the subject system to provide a new footwear donning and removal assembly which may be easily manufactured.

It is a further object of the subject system to provide a footwear donning and removal assembly which is durable.

It is a further object of the subject system to provide a new footwear donning and removal assembly which is susceptible to low cost of manufacture with regard to both materials and labor.

It is still a further object of the subject system to provide a footwear donning and removal assembly which is stable in nature during operation.

It is a further object of the subject system to provide a stable assembly which includes mechanisms for releasably capturing the footwear to a leg and foot guide mechanism.

It is a further object of the subject system to provide a frictional member within the leg and foot guide mechanism to provide additional frictional force in the releasable capturing of the footwear within the leg guide mechanism.

It is a further object of the subject system to provide a footwear donning and removal assembly which includes a footwear toe clasp to capture the toe of the footwear when a user's foot is being removed from the leg and foot guide mechanism.

It is still a further object of the subject system to provide a leg and foot guide mechanism which is mounted on a platform having a cross-sectional area greater than the footprint of the leg guide mechanism.

It is a still further object of the subject system to provide an assembly which can be easily stabilized on a base surface.

DESCRIPTION OF THE PREFERRED EMBODIMENTS

Referring now to FIGS. 1A-12, there is shown foot donning and removal system 10 for aiding a user to insert and remove a user's foot and/or user leg 14 into and out of footwear 24, as is depicted in FIGS. 3-6 and 10-12. Footwear donning and removal system 10 is adapted to be mounted on a base surface 22 for stabilization of footwear donning and removal system 10 during operation.

Footwear donning and removal system 10 includes leg and foot guide mechanism 11 forming an L-shaped passageway 12 which is formed to stabilize and releasably constrain the user's leg 14 and user's foot 16 in lateral direction 26 and vertical direction 28 during operation, as will be described in following paragraphs.

Leg and foot guide mechanism 11 forms an L-shaped passageway 12 which includes an open cross-sectional contour throughout an overall extension of leg and foot guide mechanism 11 for receiving a portion of a leg 14 and a foot 16 of the user. The open-L-shaped passageway 12 is important with respect to the open cross-sectional contour throughout the extension of the leg and foot guide mechanism 11 due to the fact that system 10 is specifically directed to users who may have conditions which do not allow for ease of donning and removal of footwear 24. Such conditions include persons who are afflicted with arthritis and a number of other medical conditions which make the donning and removal of footwear 24 difficult.

As can be seen in FIGS. 1A-12, open L-shaped passageway 12 is free of any elements which would constrain user's foot 16 in forward direction 30, since an important feature of footwear donning and removal system 10 is the ease of insert of the user's leg and foot 14 and 16 into L-shaped passageway 12.

Leg and foot guide mechanism 11 is formed in one-piece construction for structural stability of footwear donning and removal system 10. Leg and foot guide mechanism 11 includes a pair of laterally displaced side members 32, 32' with each of the laterally displaced side members 32, 32' being contoured in an L-shaped contour, as is clearly seen in FIGS. 1A-12. Laterally displaced side members 32, 32' may be formed of a substantially rigid composition such as wood, plastic, or some like composition not important to the inventive concept of the subject Application with the exception that it be sufficiently structurally rigid to constrain the user's foot 16 and leg 14 when the user's foot and leg are inserted within L-shaped passageway 12. Laterally displaced side members 32, 32' are displaced from each other in lateral direction 26 by a distance which is slightly greater than the lateral distance 26 of the user's foot 16 and leg 14. The lateral displacement of side members 32, 32' is of no importance to the subject invention concept, with the exception that it be sufficient to receive and allow removal of the user's foot 16 and leg 14.

Leg and foot guide mechanism 11 includes rear member 34, as is shown in FIGS. 1A-1B, 6-7, and 9. Rear member 34 provides stability for the user's leg and foot 14 and 16 during insertion into L-shaped passageway 12. Rear member 34 is substantially planar in nature and extends in vertical direction 28. Rear member 34 is affixed on opposing lateral sides to laterally displace side members 32, 32' by adhesion, bolting, or any similar technique to permit a substantially rigid affixment of rear member 34 to laterally displaced side members 32, 32'. In this manner, stabilization of the user's leg and foot is provided when the user's leg and foot are inserted into L-shaped passageway 12. Rear member 34 may be formed of the same composition as laterally displaced side members 32, 32' with the specific composition not being important to the inventive concept of the subject system 10 with the exception that it be substantially structurally rigid.

Leg and foot guide mechanism 11 includes platform 20 which is mounted to a lower surface of leg and foot guide mechanism 11 so that the leg and foot guide mechanism 11 is stabilized when the leg and foot 14 and 16 of the user is reversibly inserted into the L-shaped open passageway 12.

Figure 2:
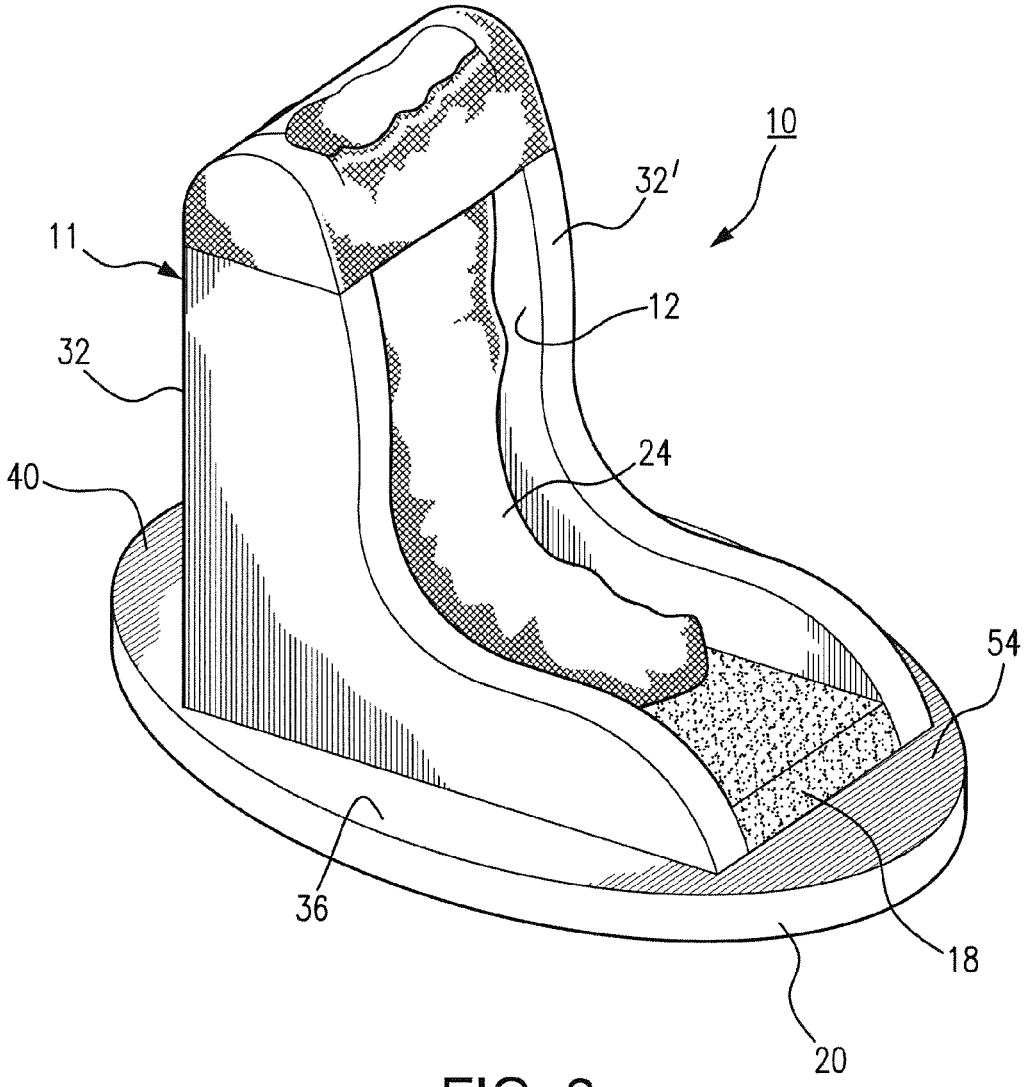
FIG. 2 is a perspective view of the footwear donning and removal system showing footwear being inserted over a pair of laterally displaced side members, prior to insertion of a user's foot.
Figure 3:
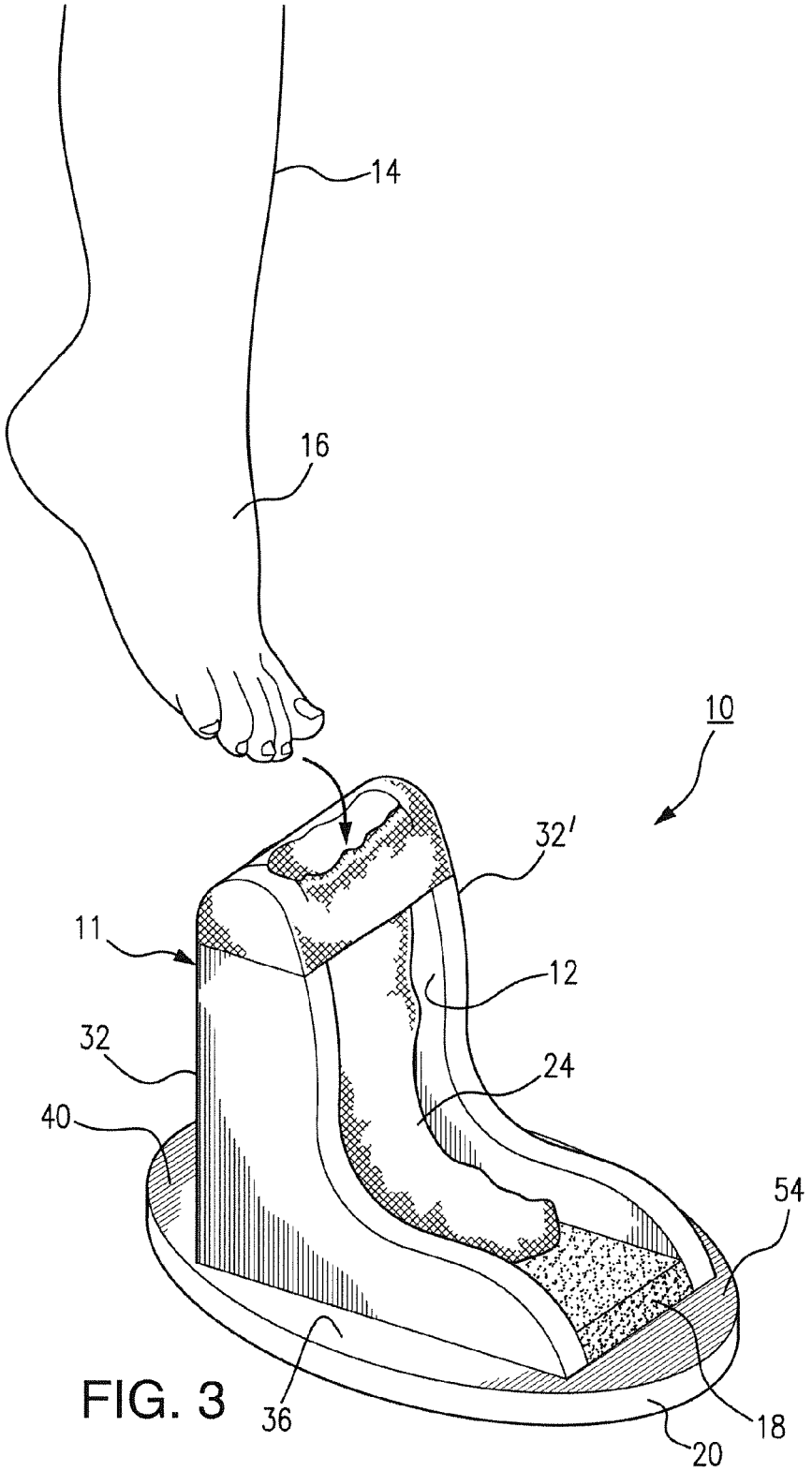
FIG. 3 shows a perspective view of a user's leg and foot prior to insertion into the perspective drawing showing the foot donning and removal system.
Figure 5:
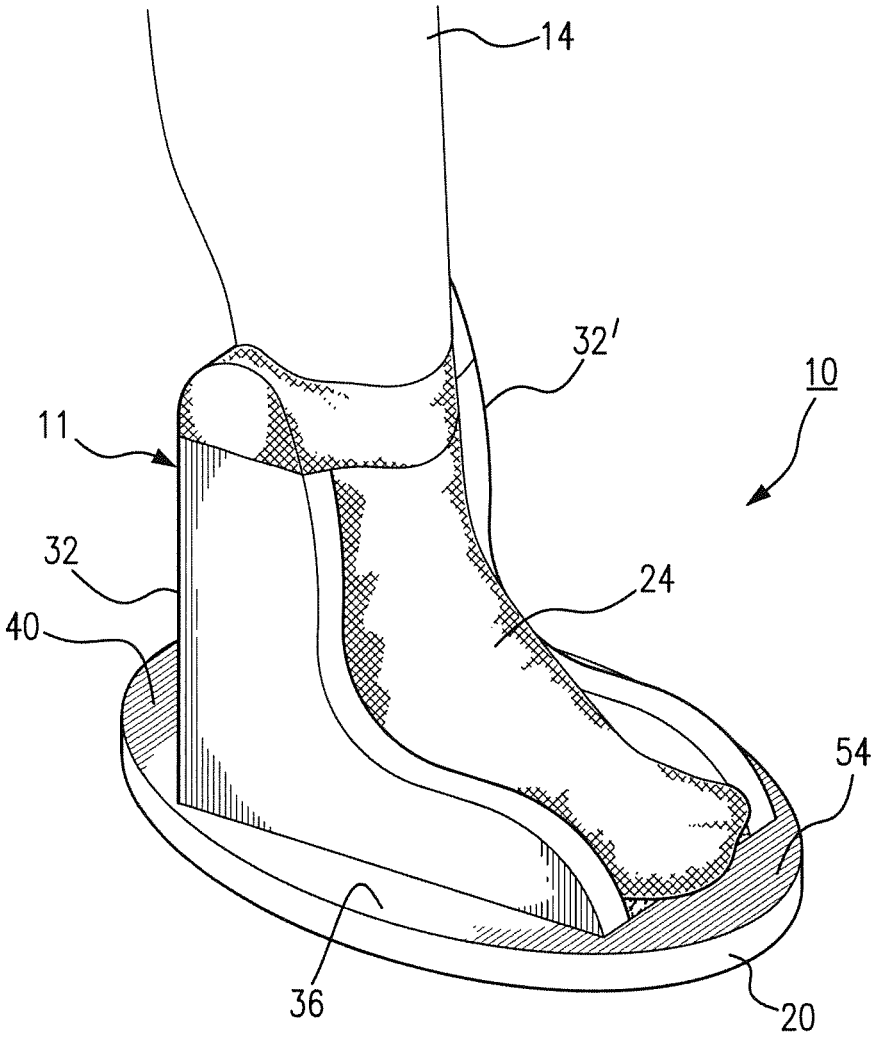
FIG. 5 is a perspective view of the footwear donning and removal system showing full insert of a user's foot into the footwear 24 within an L-shaped passageway of the leg and foot guide mechanism.

Leg and foot guide mechanism 11, as shown in all Figures, includes frictional member 18 mounted to leg and foot guide mechanism 11 within L-shaped open passageway 12. Frictional member 18 is affixed to an outer surface of rear member 34 and is sandwiched between laterally displaced side members 32, 32'. Frictional member 18 is formed of a composition having a higher coefficient of friction than laterally displaced side members 32, 32' as well as rear member 34. Frictional member 18 may be formed of an elastic and deformable composition which is deformable upon insert of user's leg and foot 14 and 16 within L-shaped passageway 12. Frictional member 18 may be formed of a plastic composition and in particular, may be formed of an open cell plastic composition to increase frictional contact when footwear 24 abuts an outer surface of frictional member 18. In this manner, footwear 24 at least partially grips frictional member 18 when footwear 24 is inserted into L-shaped passageway 12, as is seen in FIGS. 2-3, and 5.

Figure 1B:
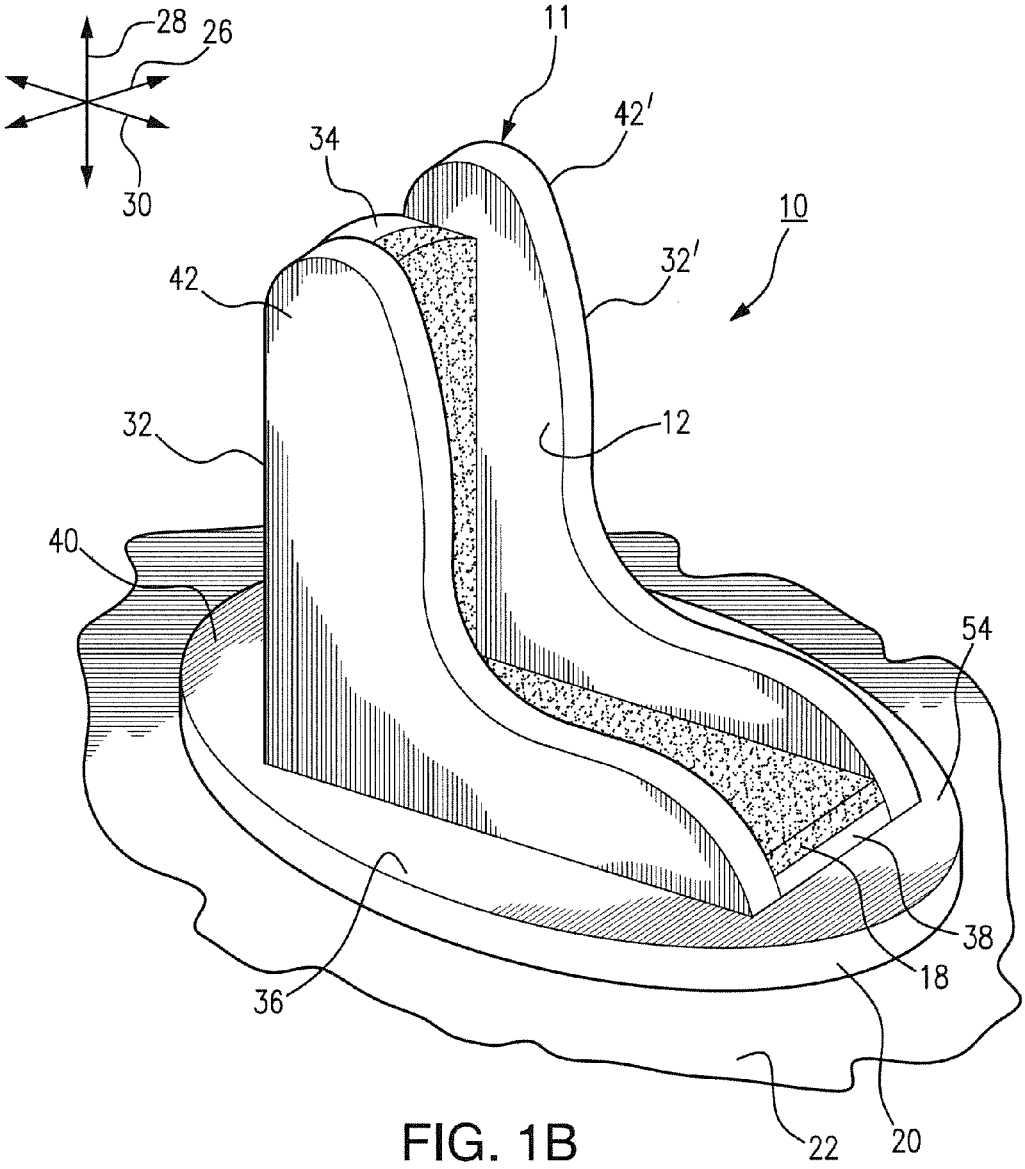
FIG. 1B is a perspective view of the footwear donning and removal system showing a component base member mounted to a platform upon which a leg and foot guide mechanism is mounted.

As seen in FIG. 1A, frictional member 18 is mounted to platform upper surface 36 in direct contact therewith. As is seen in FIG. 1B, leg and foot guide mechanism 11 may further include base member 38 which extends in lateral direction 26 between laterally displaced side members 32, 32'. In this depiction, base member 38 extends in forward direction 30 to contact rear member 34 at a lower section thereof. Base member 38 is fixed to platform 20 by adhesion to platform upper surface 36 and may be otherwise affixed by bolting, or any other suitable affixing mechanism. The important consideration being that base member 38 is fixedly attached to platform 20. In the depiction shown in FIG. 1B, frictional member 18 is affixed to base member 38 with base member 38 in itself being affixed to platform 20, as opposed to FIG. 1A, showing frictional member 18 being affixed directly to the upper surface 36 of platform 20.

In some instances, frictional member 18 may be removable from L-shaped passageway 12 and in other instances, may be affixed through any known technique which will provide adhesion of frictional member 18 either to platform upper surface 30 or base member 38.

Base member 38 may be formed of the same or similar material composition as the remaining portions of leg and foot guide mechanism 11 with the only restriction being that it be structurally stable.

Platform 20 is formed in a generally planar contour for contiguous contact with base surface 22. Platform member 20 includes a cross-sectional area greater than a cross-sectional area of leg and foot guide mechanism 11 or in other words, has a larger footprint area than that provided by laterally displaced side members 32, 32' and rear member 34. In this manner, footwear donning and removal system 10 is provided with a stabilization base for contiguous contact with base surface 22. Leg and foot guide mechanism 11 is mounted to platform 20 within the cross-sectional area of platform member 20. As is seen in FIGS. 1A-12, the placement of leg and foot guide mechanism 11 on platform 20 provides for platform member rear section 40 extending beyond the extension direction 30. Platform rear section 40 specifically provides for a user to further stabilize platform 20 on base surface 22 with the foot which is not being inserted into footwear 24 during operation.

Figure 6:
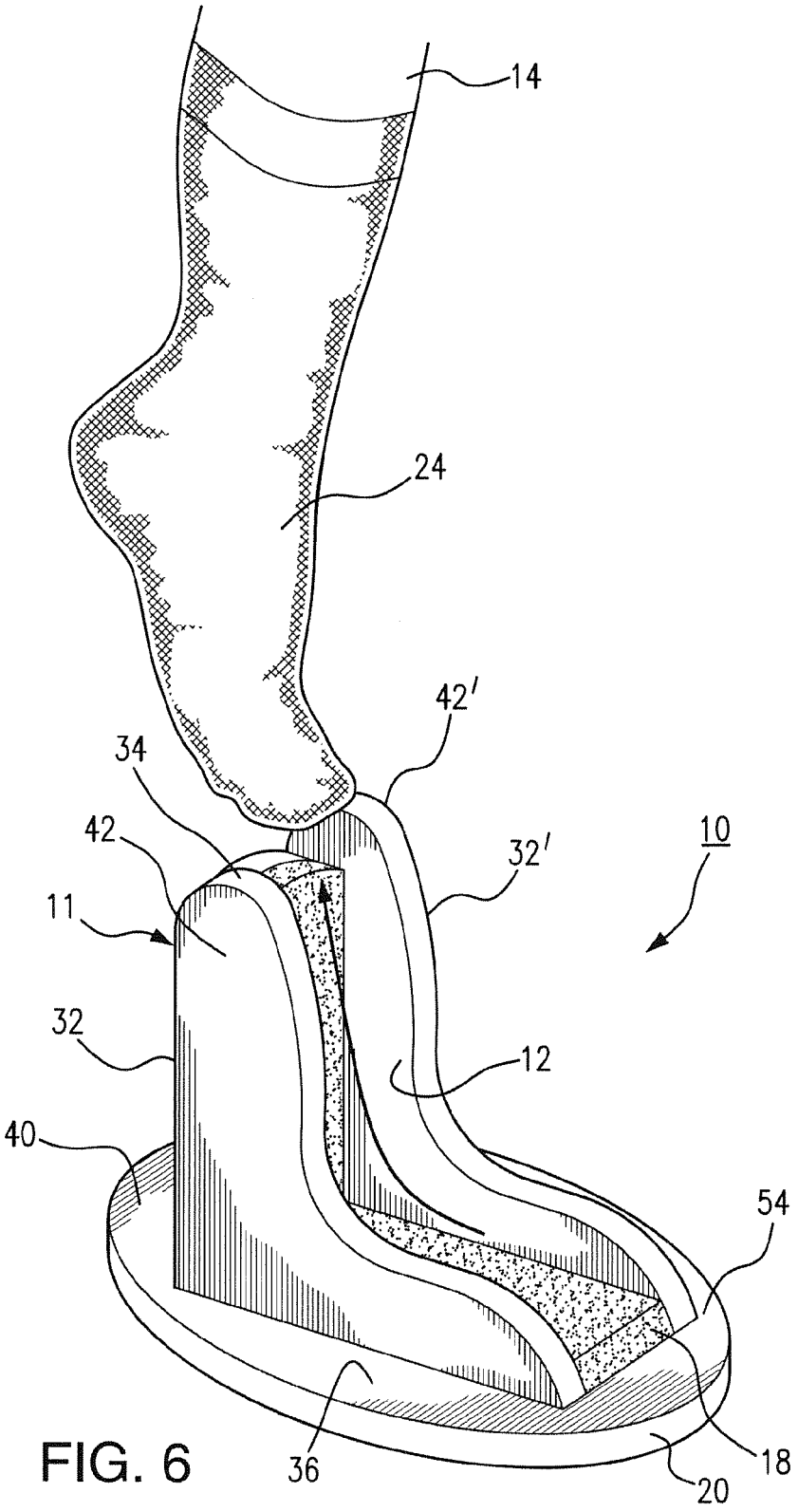
FIG. 6 is a perspective view of the footwear donning and removal system showing removal of the user's leg with the attached footwear.
Figure 6A:
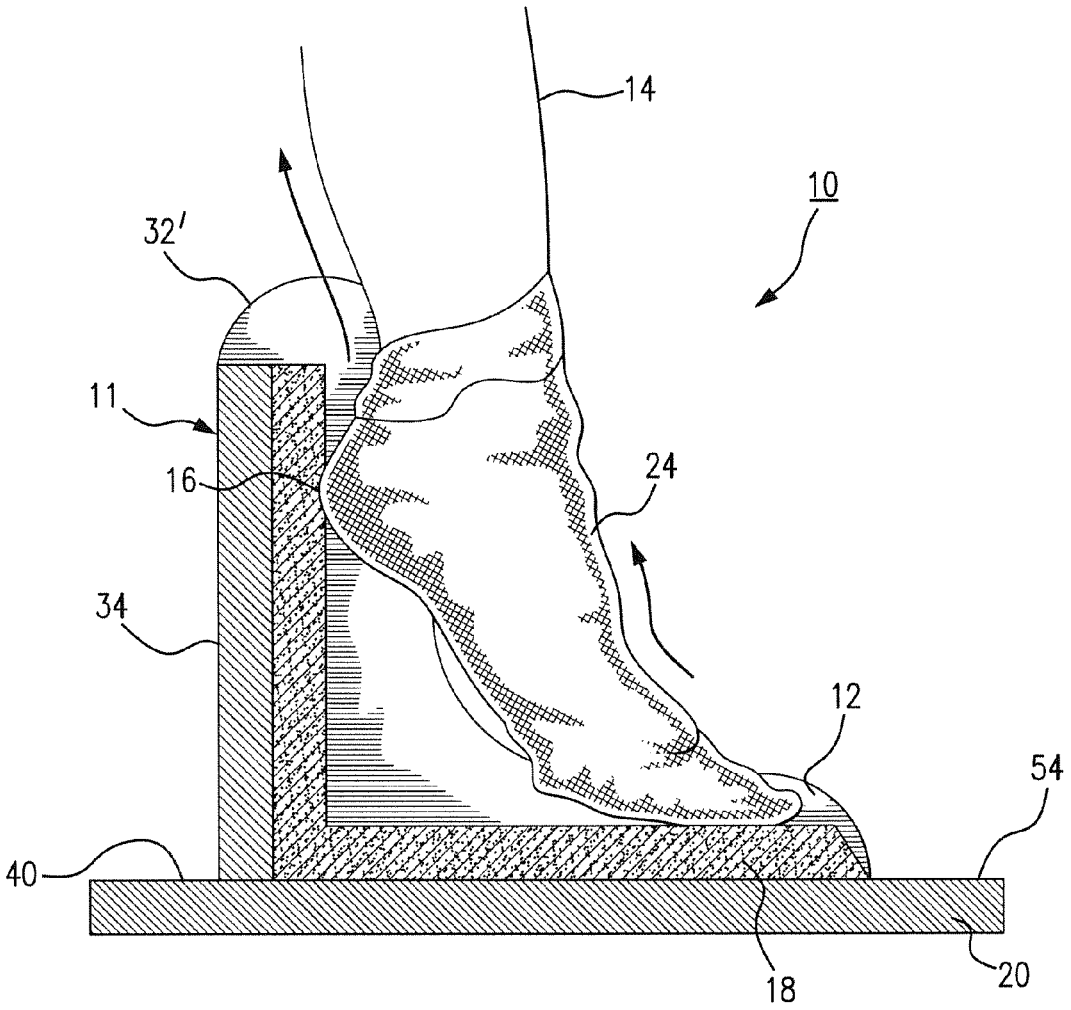
FIG. 6A is a cross-sectional view of the footwear donning and removal system showing removal of footwear from the user's foot.

FIG. 6 shows the user's leg 14 and foot 16 removed from footwear donning and removal system 10 subsequent to footwear 24 being attached to the user's leg 14 and foot 16. As shown in FIG. 6A, footwear donning and removal system 10 may be used to remove the footwear 24 from the user's leg 14 and foot 16 by the frictional engagement of footwear 24 with the frictional member 18. As the user removes his/her foot 16 and leg 14 from L-shaped passageway 12, the outer surface of footwear 24 engages frictional member 18 and permits simple removal of footwear from the user as the user removes his/her leg 14 from L-shaped passageway 12.

Figure 7:
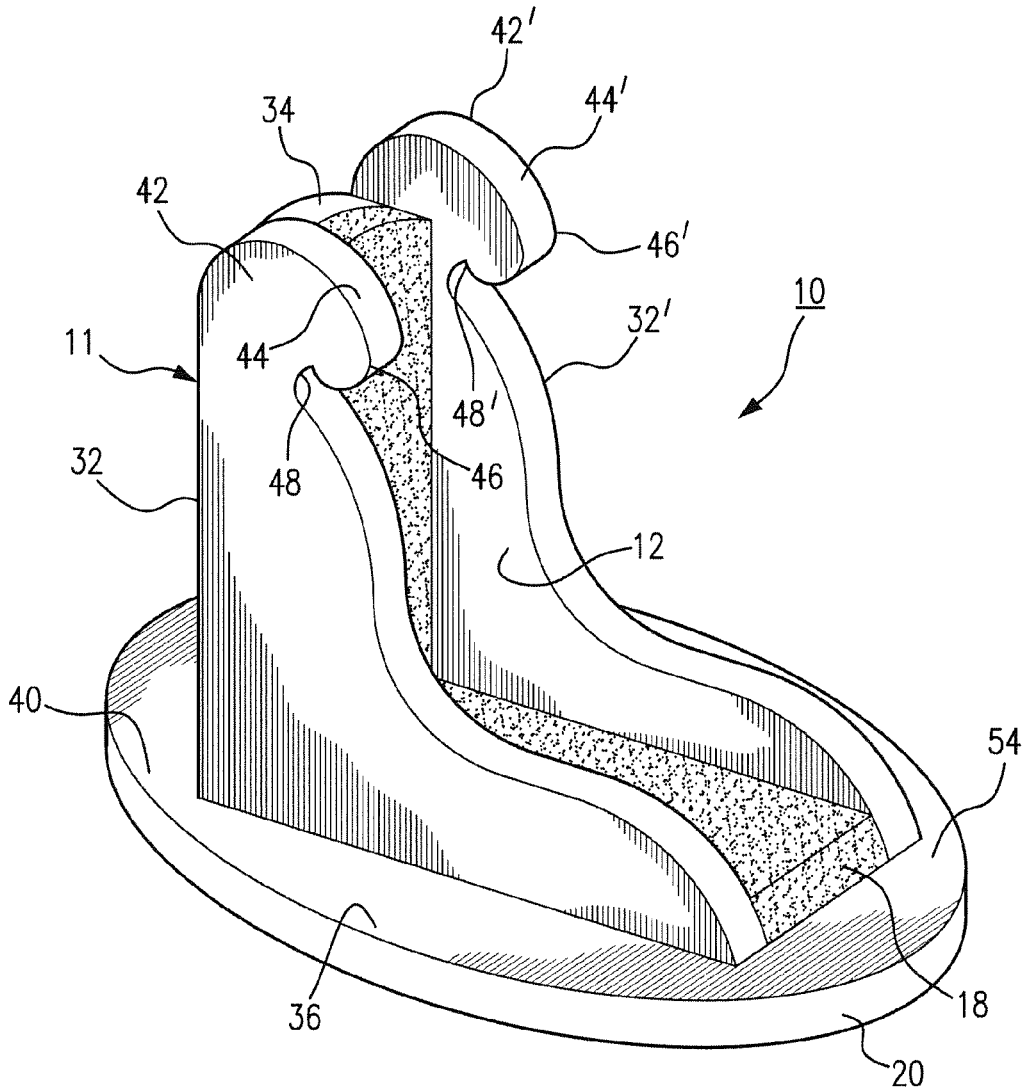
FIG. 7 is a perspective view of the footwear donning and removal system including a first upper footwear gripping mechanism for releasably securing an upper portion of the footwear to the pair of laterally displaced side members.
Figure 8:
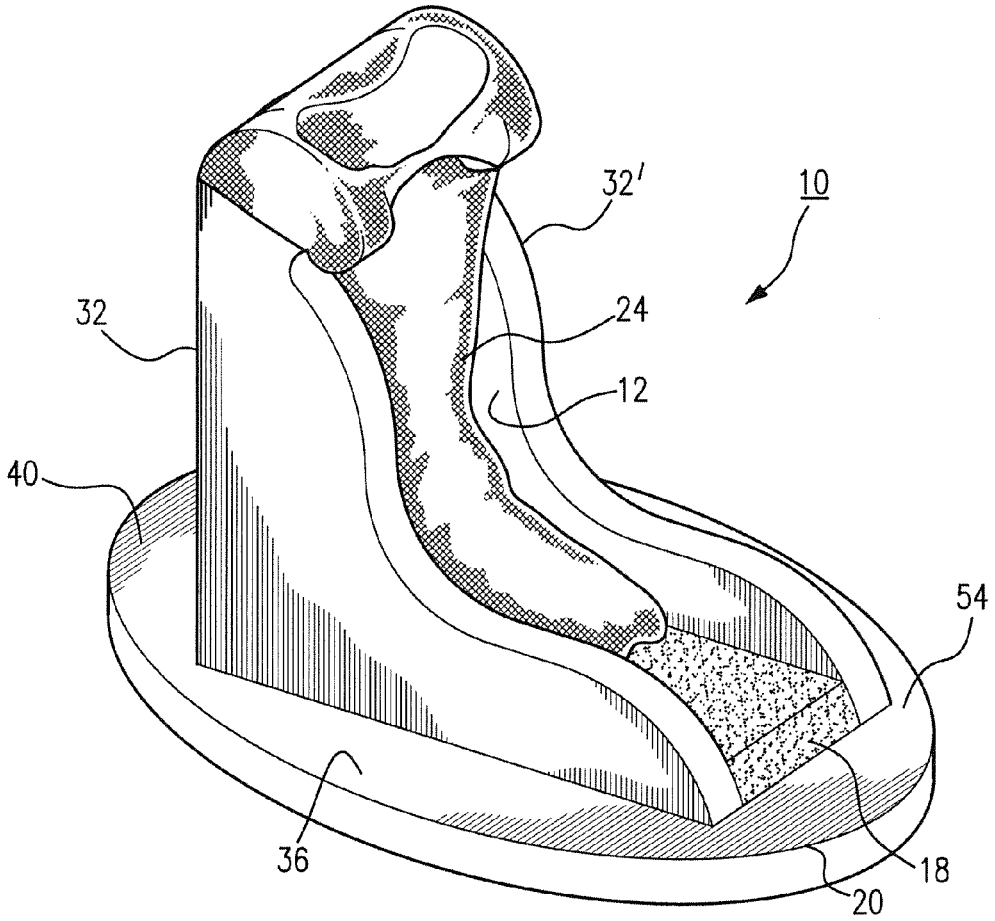
FIG. 8 is a perspective view of the footwear donning and removal system showing releasable capturing of an upper portion of the footwear onto the first upper footwear gripping mechanism.

Laterally displaced side members 32, 32' are generally substantially planar in contour. Each of laterally displaced side members 32, 32' include arcuately formed upper sections 42, 42' adapted to releasably receive an outer surface of footwear 24 either being inserted or removed from open L-shaped passageway 12. Arcuately formed upper sections of side members 42, 42' provide smooth arcuately formed upper surfaces which allow ease of mounting footwear 24 over laterally displaced side members 32, 32', as is shown in FIGS. 2-5, FIG. 8, and FIGS. 10-12. Such arcuately formed upper sections 42, 42' permit a simple and smooth mounting of footwear 24 to laterally displaced side members 32, 32'. As shown in FIG. 7, leg and foot guide mechanism 11 includes first upper footwear gripping mechanism 44, 44' which is formed in the upper arcuately formed sections 42, 42' of laterally displaced side members 32, 32'. First upper footwear gripping mechanism 44, 44' aids in the capturing of footwear 24 when footwear 24 is inserted over laterally displaced side members 32, 32' and specifically over arcuately formed upper sections 42, 42', as is seen in FIG. 8. Each of the first upper footwear gripping mechanisms 44, 44' includes a forwardly directed ledge portion 46, 46'. The forwardly directed ledge portions 46, 46' are formed coplanar with laterally displaced side members 32, 32'. Each of forwardly directed ledge portions 46, 46' include undercuts 48, 48', as is seen in FIG. 7.

In operation, as shown in FIG. 8, footwear 24 is folded over arcuately formed upper sections of side members 42, 42'. The footwear 24 is then further folded over forwardly directed ledge portions 46, 46' and edges of footwear 24 are inserted into ledge portion undercuts 48, 48'. In this operation, footwear 24 is removably secured to leg and foot guide mechanism 14 of footwear donning and removal system 10.

Figure 9:
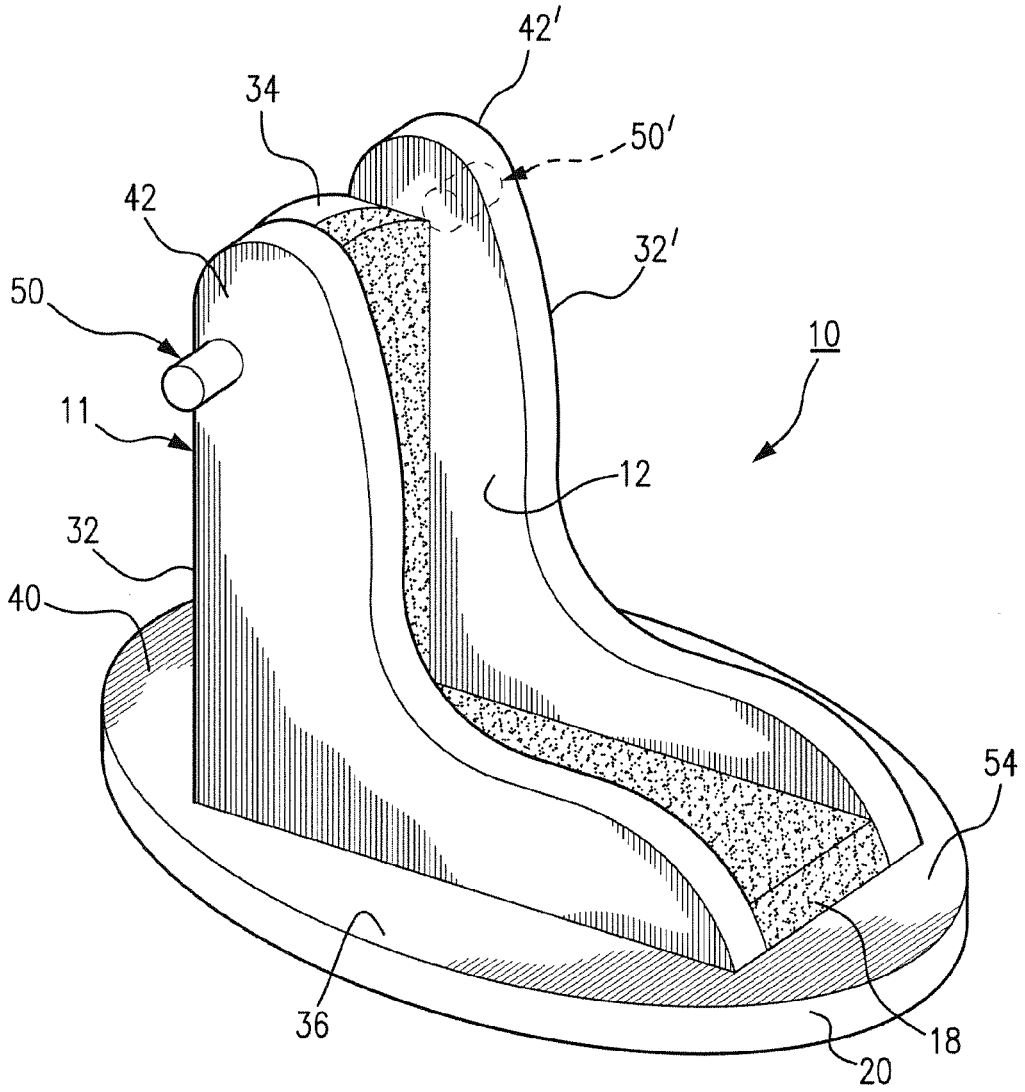
FIG. 9 is a perspective view of the footwear donning and removal system showing a second upper footwear gripping mechanism in the form of pegs which extend laterally from the laterally displaced side members.

As seen in FIG. 9, a second upper footwear gripping mechanism 50, 50' may be mounted to arcuately formed upper sections 42, 42' of side members 32, 32'. Second upper gripping footwear mechanism 50, 50' may be peg members 52, 52' which extend in lateral direction 26 external each side member 32 and 32'. Peg members 52, 52' are rigidly secured to side members 32, 32' through any well-known technique of rigid securement, such as adhesive techniques, bolting, or some like technique.

Figure 10:
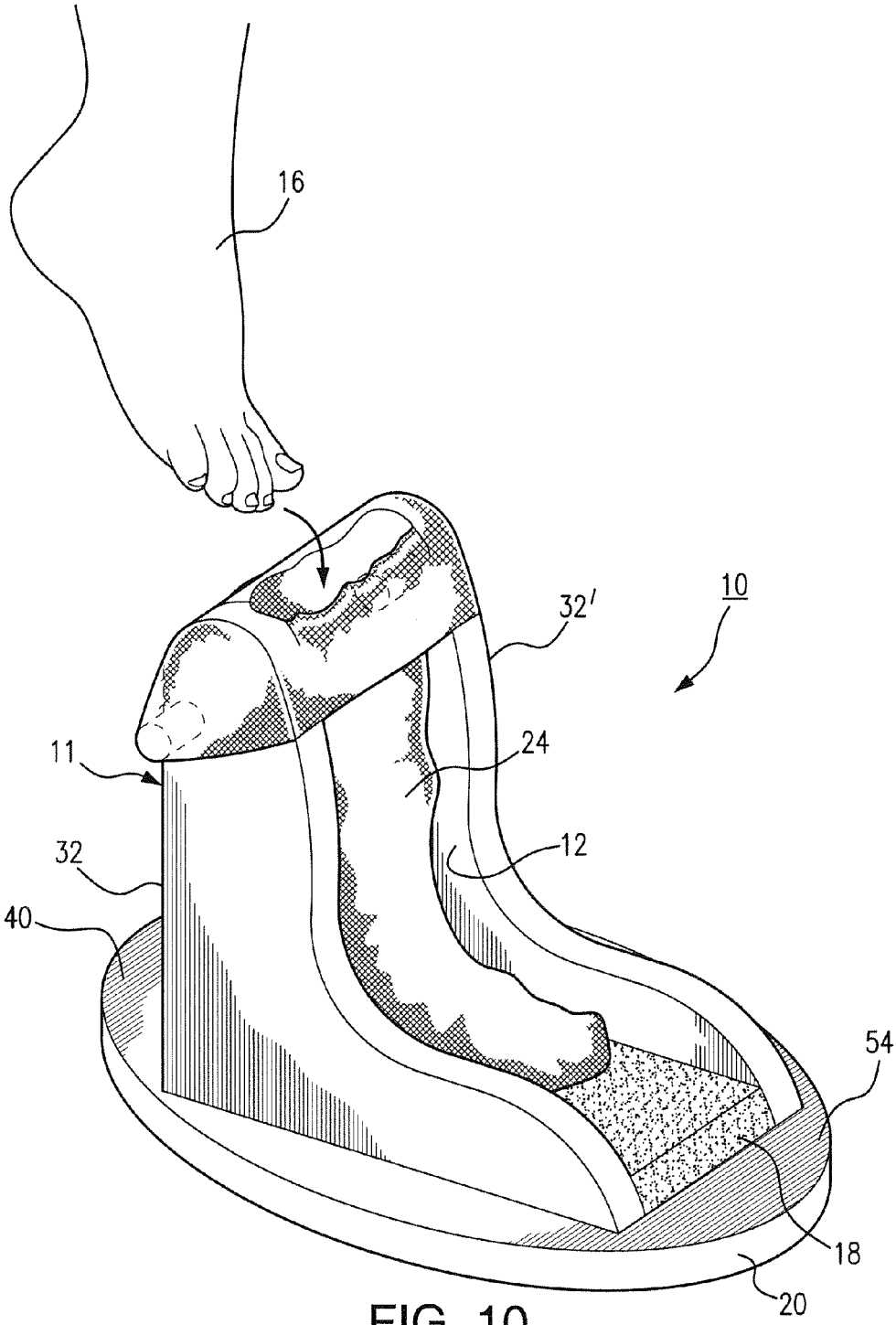
FIG. 10 is a perspective view of the footwear donning and removal system showing the mounting of an upper section of the footwear to the second upper footwear gripping mechanism prior to insertion of the user's foot into the footwear.

As seen in FIG. 10, an upper portion of the outer surface of footwear 24 is inserted over arcuately formed upper sections 42, 42' of display side members 32, 32'. Additionally, the upper outer surface of footwear 24 is extended over the peg members 52, 52' in order to provide a releasable securement therewith. In this manner, insert of the user foot 16 can easily be provided while footwear 24 is maintained in relative stability with respect to the L-shaped passageway 12.

Figure 11:
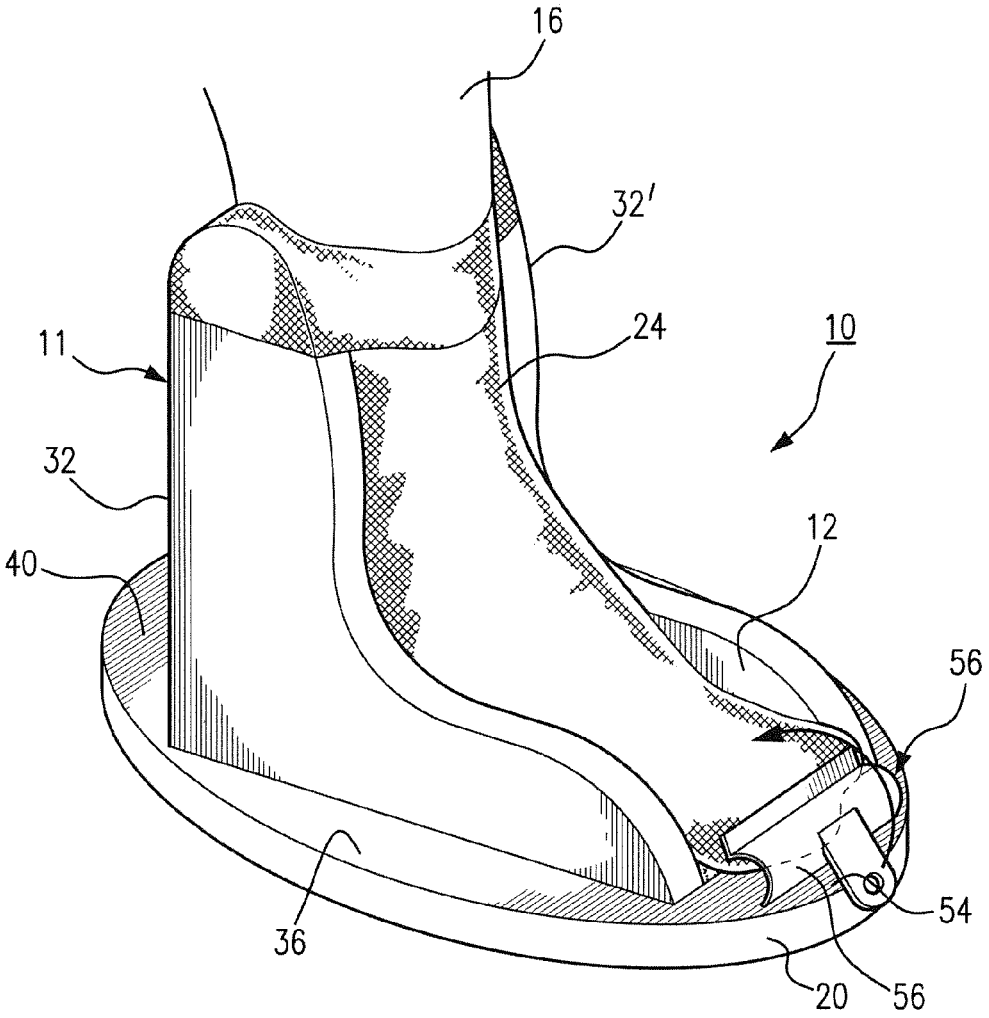
FIG. 11 is directed to a perspective view of the footwear donning and removal system showing a toe clasping mechanism which is adapted to releasably clasp a toe section of the footwear; and, FIG. 12 is directed to a perspective view of the footwear donning and removal system showing the toe clasping mechanism clasping an end section of the footwear in order that the user may remove his/her foot from the footwear.
Figure 12:
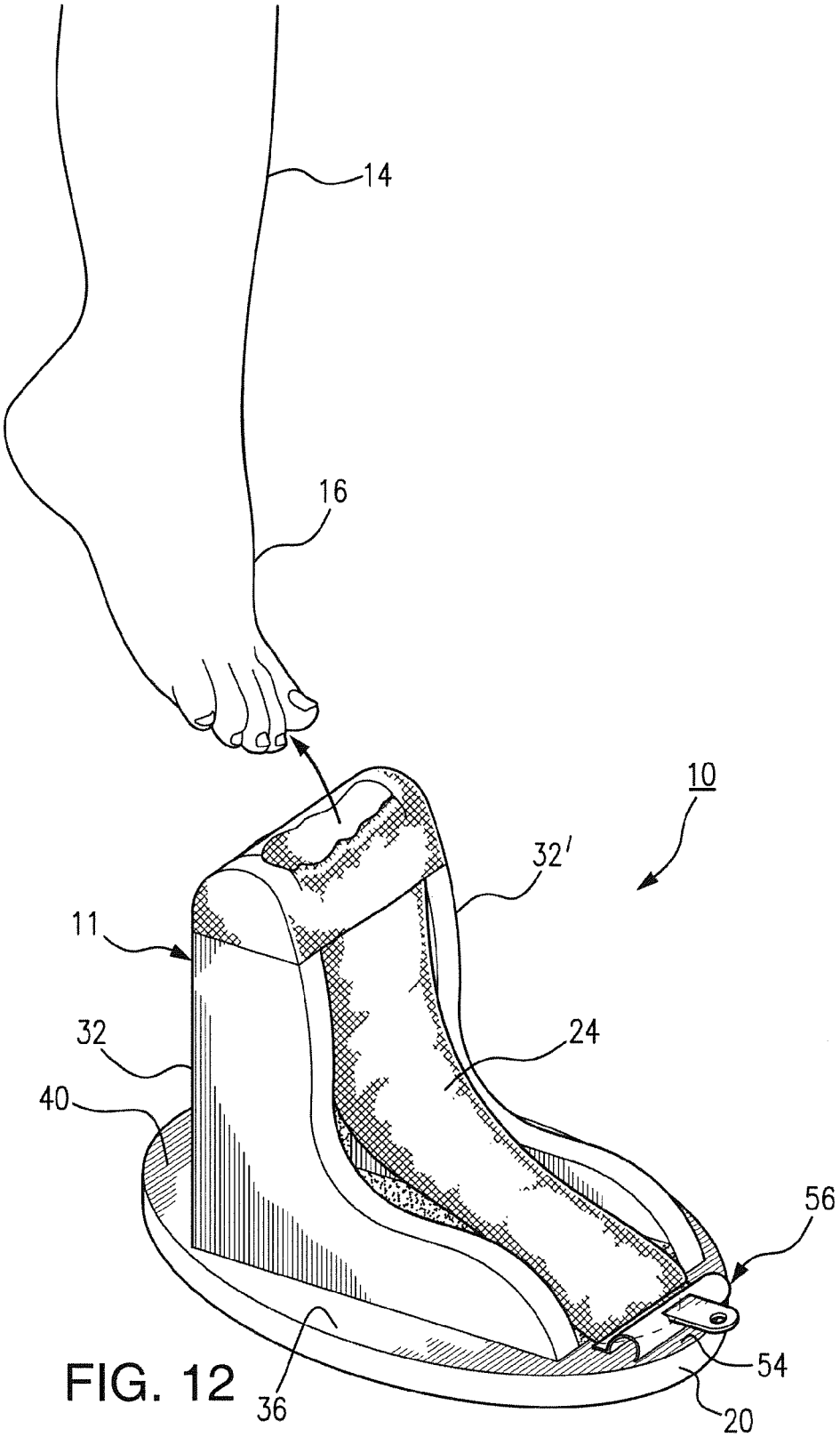

As shown in FIG. 11, leg and foot guide mechanism 11 includes toe clasping mechanism 56 secured to frontal section 54 of platform member 20. Toe clasping mechanism 54 may be in the form of the well-known alligator type clip 56 for releasably clasping the toe section of footwear 24 to an upper surface of platform member 20. FIG. 11 is particularly adapted for removal of footwear 24 from user foot and leg 16 and 14. In operation, the user wearing footwear 24 inserts foot and leg 16 and 14 into L-shaped passageway 12. Toe clasping mechanism 56 then clamps a free end of a toe portion of footwear 24. The user may then easily remove his/her foot 16 from the L-shaped passageway of leg and foot guide mechanism 11 in a simple pulling action.

Figure 4:
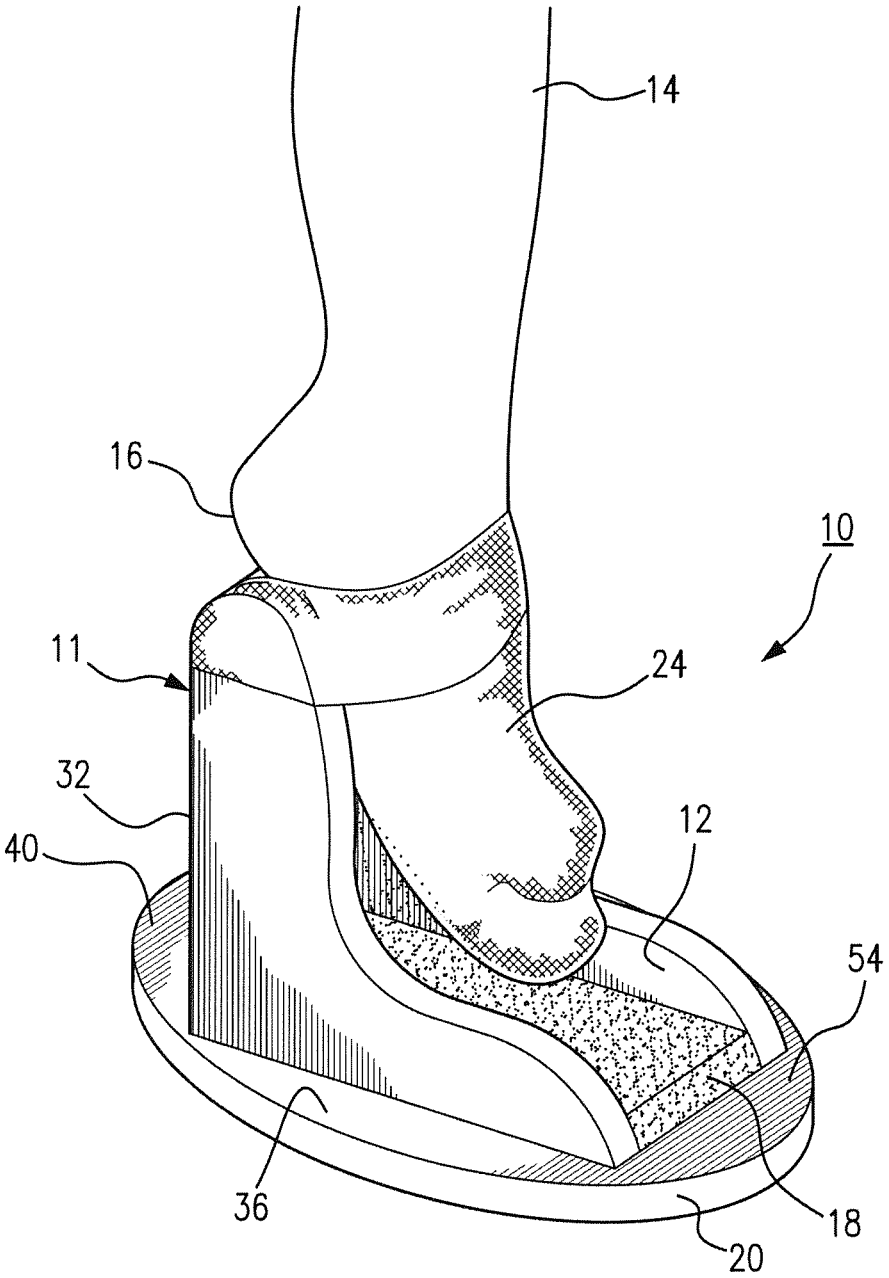
FIG. 4 is a perspective view of the footwear donning and removal system showing the footwear being mounted to the leg and foot guide mechanism with partial insert of a user's foot.

Operationally, as seen in FIGS. 3-6, initially footwear 24 is inserted over the arcuately formed upper sections 42, 42' of laterally displaced side members 32, 32'. The user then inserts foot 16 within footwear 24 as seen in FIG. 4. The user continues to insert foot portion of leg 14 into footwear 24, as is seen in FIG. 5. Once this is done, the upper sections of footwear 24 may be removed from laterally displaced members 32, 32' and the foot and leg may be removed from L-shaped passageway 12 as seen in FIG. 6. A similar operation is shown in FIGS. 7-10 with respect to first and second upper footwear gripping mechanisms 44, 44' and 50, 50'.

Although this invention has been described in connection with specific forms and embodiments thereof, it will be appreciated that various modifications other than those discussed above may be resorted to without departing from the spirit or scope of the invention as defined in the appended Claims. For example, functionally equivalent elements may be substituted for those specifically shown and described, certain features may be used independently of other features, and in certain cases, particular locations of the elements may be reversed or interposed, all without departing from the spirit or scope of the invention as defined in the appended Claims.

What is claimed is:

1. A footwear donning and removal system comprising:

(a) a one-piece leg and foot guide mechanism forming an L-shaped open passageway, said leg and foot guide mechanism including a pair of laterally displaced side members, each of said laterally displaced side members being contoured in an L-shaped contour and said L-shaped open passageway having an open cross-sectional contour throughout an overall extension of said leg and foot guide mechanism and adapted to receive a portion of a leg and foot of a user;

(b) a frictional member mounted to said leg and foot guide mechanism, said frictional member extending in a vertical and horizontal direction within said L-shaped open passageway in contiguous contact therewith throughout an entire length of said L-shaped open passageway;

(c) a platform mounted to a lower surface of said leg and foot guide mechanism whereby said leg and foot guide mechanism is stabilized when said leg and foot of the user is reversibly inserted into said L-shaped open passageway; and, (d) an upper footwear gripping mechanism formed laterally in an upper section of each of said laterally displaced side members for releasably capturing said footwear to said laterally displaced side members, said upper footwear gripping mechanism adapted to receive and be encompassed by an upper section of said footwear which extends over an upper end of each of said laterally displaced side members.

2. The footwear donning and removal system as recited in claim 1 including a rear member extending in a lateral direction and affixed to each of said laterally displaced side members and further extending throughout a portion of a vertical extension of said pair of laterally displaced side members.

3. The footwear donning and removal system as recited in claim 2 where said frictional member is affixed to a surface of said rear member and an upper surface of said platform member.

4. The footwear donning and removal system as recited in claim 2 including a base member extending in a lateral direction and affixed to each of said laterally displaced side members and extending throughout a horizontal extension of said pair of laterally displaced side members.

5. The footwear donning and removal system as recited in claim 4 where said frictional member is affixed to a surface of said rear member and an upper surface of said base member.

6. The footwear donning and removal system as recited in claim 2 where said platform member includes a cross-sectional area greater than a cross-sectional area of said leg and foot guide member.

7. The footwear donning and removal system as recited in claim 1 where said frictional member is formed of a composition having a higher coefficient of friction than said leg and foot guide mechanism.

8. The footwear donning and removal system as recited in claim 7 where said frictional member is formed of an elastic composition which is deformable upon insert of a user's leg and foot within said L-shaped open passageway.

9. The footwear donning and removal system as recited in claim 7 where said frictional member is formed of a plastic composition.

10. The footwear donning and removal system as recited in claim 9 where said frictional member is formed of an open cell plastic composition.

11. The footwear donning and removal system as recited in claim 1 where each of said laterally displaced side members is substantially planar in contour, each of said laterally displaced side members having an arcuately formed upper section adapted to releasably receive an outer surface of footwear inserted into said L-shaped open passageway between said laterally displaced side members.

12. The footwear donning and removal system as recited in claim 1 where said upper footwear gripping mechanism includes a forwardly directed ledge portion of each of said laterally displaced side members.

13. The footwear donning and removal system as recited in claim 12 where each of said forwardly directed ledge members is formed in said plane of said laterally displaced side members and is arcuate in contour.

14. The footwear donning and removal system as recited in claim 13 where each of said forwardly directed ledge members includes an undercut for receiving an end portion of an upper portion of said footwear.

15. The footwear donning and removal system as recited in claim 1 where said upper footwear gripping mechanism includes a pair of lug members extending from respective lateral opposing sides of said laterally displaced side members and affixed to said respective side members.

16. The footwear donning and removal system as recited in claim 15 where said lug members are peg members having a substantially cylindrical contour.

17. The footwear donning and removal system as recited in claim 1 including a toe clasping mechanism fixed to a frontal section of said platform member for releasably clasping a toe section of said footwear.

18. The footwear donning and removal system as recited in claim 17 where said toe clasping mechanism is an alligator clip for releasably clasping said toe section of said footwear to an upper surface of said platform.

* * * * *